US007155890B2

(12) United States Patent
Kawamura et al.

(10) Patent No.: US 7,155,890 B2
(45) Date of Patent: Jan. 2, 2007

(54) PRODUCTION DEVICE FOR CARBON FIBERS AND PRODUCTION METHOD THEREFOR

(75) Inventors: Atsushi Kawamura, Hiroshima (JP); Hiroshi Inagaki, Hiroshima (JP); Takahiko Kunisawa, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 145 days.

(21) Appl. No.: 10/479,973

(22) PCT Filed: Jun. 11, 2002

(86) PCT No.: PCT/JP02/05792

§ 371 (c)(1),
(2), (4) Date: Dec. 12, 2003

(87) PCT Pub. No.: WO02/101129

PCT Pub. Date: Dec. 19, 2002

(65) Prior Publication Data

US 2004/0168425 A1 Sep. 2, 2004

(30) Foreign Application Priority Data

Jun. 12, 2001 (JP) ..... 2001-177127

(51) Int. Cl.
*B65H 69/06* (2006.01)

(52) U.S. Cl. ..... 57/22; 57/261

(58) Field of Classification Search ..... 57/22, 57/23, 202, 261, 263; 28/141; 423/447.4; 264/29.2

See application file for complete search history.

(56) References Cited

U.S. PATENT DOCUMENTS 4,466,949 A 8/1984 Mori
4,577,458 A 3/1986 Garnsworthy
6,485,592 B1 * 11/2002 Yoshimura et al. ..... 156/148
6,722,116 B1 * 4/2004 Takeuchi et al. ..... 57/22
2002/0157765 A1 * 10/2002 Takeuchi et al. ..... 156/157

FOREIGN PATENT DOCUMENTS

| | | |
|---|---|---|
| EP | 909842 | 4/1999 |
| JP | 49-35665 | 4/1974 |
| JP | 54-50624 | 4/1979 |
| JP | 58-37315 | 4/1981 |
| JP | 1-12850 | 3/1989 |
| JP | 2-178177 | 7/1990 |
| JP | 4-214414 | 8/1992 |
| JP | 11-124741 | 5/1999 |
| JP | 2000-26026 | 1/2000 |

* cited by examiner

*Primary Examiner*—Shaun R. Hurley
(74) *Attorney, Agent, or Firm*—Oblon, Spivak, McClelland, Maier & Neustadt, P.C.

(57) ABSTRACT

A production device and production method for carbon fibers of the present invention is utilized to reliably obtain a connecting portion having a high process passing property with a simple mechanism so as to achieve a continuous operation and improve a firing process operability for achieving a low cost. A pair of yarn gripping devices for overlaying precursor fiber yarns to be connected one upon another and gripping the overlaid ends is provided, and a fluid processing unit for applying an entangling process by jetting a plurality of rows of fluid in along a yarn length direction is provided between the pair of yarn gripping devices. A plurality of discontinuous thread handling areas of the precursor fiber yarns in a fluid jet area of the fluid processing unit having fluid jet holes are disposed at predetermined intervals.

10 Claims, 4 Drawing Sheets

PRODUCTION DEVICE FOR CARBON FIBERS AND PRODUCTION METHOD THEREFOR

TECHNICAL FIELD

The present invention relates to a production device for carbon fibers, comprising an end connecting device for connecting a trailing end of a preceding precursor fiber yarn and a leading end of a following precursor fiber yarn, and a continuous production method for carbon fibers by connecting the ends of precursor fiber yarns using the production device. More specifically, the invention relates to a production device and a production method for carbon fibers for applying a flame resistant process to precursor fiber yarns at the time of producing carbon fibers, and then applying a carbonizing process, characterized in a connecting device and a connecting method for yarns at the time of continuously supplying precursor fiber yarns.

BACKGROUND ART

Carbon fibers have started to spread also for industrial applications such as architecture, engineering, and energy related use in addition to the conventional applications such as aircraft and sports gear, with the demand therefor rapidly increased. In order to further accelerate the increase, realization of a carbon fiber of a lower cost is desired. As a representative precursor fiber yarn for producing a carbon fiber, there is an acrylic based fiber yarn, which is widely used. According to the common carbon fiber production, carbon fibers are produced by obtaining flame resistant fibers by a flame resistant process of applying a heating process to acrylic based fiber yarns in an oxidizing atmosphere of 200 to 300° C., and subsequently a carbonizing process of applying a heating process in an inert atmosphere of 1,000° C. or higher. Since the carbon fibers thus obtained have various excellent physical properties, as mentioned above, they are used widely as reinforcing fibers for various kinds of fiber reinforcing composite materials, or the like in many fields.

In general, the acrylic based fiber yarns as the precursor fiber yarns for the carbon fiber production are supplied in a form wound up on a bobbin, or the like, or in a form folded and stacked in a box. Therefore, in order to achieve a low cost and improve the operability of a firing process including a flame resistant process and a carbonizing process, a trailing end of an acrylic based fiber yarn of the aforementioned form needs to be connected with a leading end of another acrylic based yarn for providing a carbon fiber, because it is necessary for continuously transmitting the acrylic based fiber yarns and applying the firing process thereto so as to produce a carbon fiber.

As means for improving the operability in the firing process by continuously supplying the acrylic based yarn fibers in a production process for carbon fibers with connecting the ends, for example, Japanese Patent Application Laid-Open No. 54-50624 discloses a method for applying to a connecting portion of acrylic based fiber yarns a flame resistant compound such as diester oil, silicone oil, halogenated hydrocarbon, and a grease obtained from ore oil and a metal soap. Moreover, Japanese Patent Application Laid-Open No. 56-37315 discloses a method for forming a connecting portion by preliminarily tying the end as a loop of an acrylic based fiber yarn after applying a thermal process, and entangling the same with the loop of another one. Furthermore, the Japanese Patent Application Publication No. 1-12850 discloses a method for forming a connecting portion by entangling ends of acrylic based fiber yarns. Moreover, Japanese Patent Application Laid-Open No. 4-214414 discloses a method for forming a connecting portion by entangling ends of acrylic based fiber yarns, and furthermore, adhering to the connecting portion an oxidization reaction inhibiting agent such as boric acid, ammone sulfamate, sodium sulfite, and urea based compound, respectively.

However, the acrylic based fiber yarns having the connecting portions connected by the methods disclosed in the above publications are not compatible with the production condition for high speed production for carbon fibers having the excellent physical property. This is because the acrylic based fiber yarns having the connecting portions by the above methods cannot stably pass through a step of providing flame resistant fibers by a flame resistant process with high heating temperature and processing tension with respect to the acrylic based fiber yarns, and a step of providing carbon fibers by a carbonizing process with a high processing tension. In particular, in the case of connecting the precursor fibers with each other, burning and thread breakage are generated due to heat accumulation at the connecting portion.

Therefore, for passage of the flame resistant process and the carbonizing process by the acrylic based fiber yarns having the connecting portions by the connecting methods without a problem, the condition of either the flame resistant process with the high heating temperature and processing tension or the carbonizing process with the high processing tension should be alleviated, and thus the carbon fibers can hardly be produced by high speed production.

However, in the case where the acrylic based fiber yarns are connected by merely tying the ends thereof with each other, drastic heat accumulation is caused at the connecting portion in the flame resistant process so that this causes the troubles such as the thread breakage in the subsequent carbonizing process.

Furthermore, for example, Japanese Patent Application Laid-Open No. 10-226918 discloses a method for producing a carbon fiber by connecting precursor fibers for carbon fiber production via a no heat generating connecting medium at a flame resistant temperature by entanglement at the single thread level, and a production device therefor. Gripping means for the precursor yarns and gripping means for the connecting medium exist independently, and moreover, relax gripping portion for each entangling nozzle, that is, a plurality of relax gripping means are provided. Furthermore, each of the relax gripping means comprises a mechanism to be moved independently with each other for providing a predetermined slacking amount to the precursor yarns, and thus it is an extremely complicated mechanism. Moreover, although it is mentioned that a plurality of nozzles are disposed at a predetermined portion for the connecting process over a predetermined length so as to execute bonding by fluid process at each portion, the number of arranged nozzles, or the arrangement interval are not specifically shown.

Thus, according to the prior arts, a connecting portion capable of realizing a certain process passing property with a device having a simple mechanism has not been obtained.

Therefore, an object of the present invention is to certainly obtain a connecting portion having a high process passing property with a simple mechanism in a production device and a production method for carbon fibers so as to achieve continuous operation and improve the firing process operability for achieving a low cost.

DISCLOSURE OF THE INVENTION

The principal feature of the present invention for solving the problem is a device for connecting precursor fiber yarns for carbon fiber production, being characterized by comprising a pair of yarn gripping devices for overlaying and gripping precursor fiber yarns to be connected, and a fluid processing unit disposed between the pair of yarn gripping devices for applying an entangling process by jetting a plurality of rows of fluid with respect to a longitudinal direction to the part with an overlaid part of the precursor fiber yarns, in which thread handling areas of the precursor fiber yarns in the area comprising the fluid processing unit having fluid jet holes are disposed discontinuously at predetermined intervals.

As the precursor fiber yarn for the carbon fiber production in the present invention, in general, an acrylic based fiber yarn is used. The acrylic based fiber yarn is not particularly limited as long as it is an acrylic fiber containing an acrylonitrile as the main component, but an acrylic fiber comprising 95% by mass or more of acrylonitrile and 5% by mass of a vinyl based monomer copolymerizable with acrylonitrile is preferable. Furthermore, it is preferable that the vinyl based monomer is one or more kinds of monomers selected from the group of the monomers having a flare resistant reaction promoting effect, consisting of acrylic acid, methacrylic acid, itaconic acid, or an alkaline metal salt or an ammonium salt thereof, and acrylic amide.

In the carbon fiber production process in general, the precursor fiber yarns comprising the acrylic based fiber yarns, or the like are processed to be flame resistant fibers by a flame resistant process applying heating process in an acidic atmosphere of 200 to 300° C., and then providing carbon fibers by a carbonizing process applying heating process in an inert atmosphere of 1,000° C. or higher.

The kind of the pair of gripping devices for overlaying and gripping the precursor fiber yarns in the present invention is not particularly limited as long as they can overlay and grip the fiber yarns to be connected with each other, such as a nipping device for clamping and fixing yarns. The shape of the yarn gripping portion can be determined optionally according to the number of filaments and the number of deniers. Furthermore, it is further preferable to provide a mechanism for slackening the part to be entangled and connected to be described later by the operation for shortening the span, or the like after the pair of nipping mechanisms nip the acrylic fiber yarns from the viewpoint of executing the connection by the entangling process further effectively.

In the present invention, the fluid processing means disposed between the pair of gripping portions for applying an entangling process by simultaneously jetting a plurality of rows of fluid with respect to a longitudinal direction of the overlaid part of the fiber yarns is, as shown in FIG. 1, fluid processing means having fluid jet holes on thread handling areas along the overlaid yarns. As shown in FIG. 2, the thread handling areas are not formed continuously over the entire area of the fluid processing unit, but they are disposed with intervals per the plurality of rows of fluid jet holes provided in the longitudinal direction.

Moreover, the fluid processing unit has fluid jet holes disposed in a plurality of rows with respect to the longitudinal direction of the thread handling areas along the yarns. The fluid can be supplied and jetted separately in respective fluid jet holes disposed in the plurality of rows, or it is also possible to supply and jet the fluid collectively and simultaneously. In terms of the operability and the time needed for the connection process, the latter is advantageous.

In the case where the thread handling areas are provided in the continuous structure without having the interval in each row of the fluid jet holes, wherein the fluid is supplied collectively, the fluids jetted form the fluid jet holes disposed in the plurality of rows along the yarns interfere with each other in the thread handling areas. Particularly in the case of the fluid jetted in the vicinity of the center of the fluid processing means out of the fluid jet holes disposed in plural rows, due to a high pressure resistance, the jetting amount necessary for the entanglement of the yarns cannot be obtained. As a result, sufficient entanglement of the yarns cannot be obtained in the vicinity of the center. In the case where the thread handling areas are provided continuously, even when the fluid is supplied individually for each row of the fluid jet holes, since the fluid jetting lengths along the thread handling areas differ, turbulence of the yarns is generated due to the turbulence of the jetted fluid flow, which is considered to be derived from the thread handling area length to be described later so that the respective entanglement cannot be even.

For the cross section of the thread handling area for overlaying and storing the fiber yarns to be connected with each other, various shapes can be adopted according to the cross sectional shape of the yarns. However, as shown in FIG. 2, a flat rectangular shape is particularly preferable. Although the size thereof differs depending on the total fineness of the yarns to be connected, the shorter side of the flat rectangular cross sectional shape of the thread handling areas, which is in the yarn overlaying direction, that is, in the height direction is 1 to 5 mm, and preferably it is 2 to 4 mm. When the height is small, that is, the thickness of the yarns is limited, the connecting portion tends to be firm so as to be the cause of the heat accumulation in the firing process. In contrast, when the size is large, although it depends on the relationship with the longer side size, the entanglement tends to be insufficient due to thickening of the fiber bundle thickness to be connected.

Concerning the longer side size, there is a preferable value dependent on the total deniers of the two yarns to be connected. The value is the ratio D/L of the total fineness D (dTex) and the longer side size L (mm) of the acrylic fiber yarn to be connected, and it is preferable that the value is 2,000 to 5,000. When the D/L is 2,000 or less, the yarns are not spread in the entire thread handling area in a width direction thereof, so that the two yarns are overlaid with displacement so as to generate twisting at the time of the entanglement, or in an extreme case, the two yarns are in the sate adjacent with each other so as not to achieve the entanglement. Moreover, in contrast, when the value is 5,000 or more, that is, if the longer side size of the flat rectangular cross section is short, sufficient combination and entanglement cannot be generated due to the large thickness of the yarn.

As shown in FIG. 2, the fluid jet holes provided in a plurality of rows along the longitudinal direction of the thread handling area are provided with arranging a plurality of small holes in the longer side direction of the thread handling areas with the flat rectangular cross sectional shape. The bore of each fluid jet hole is preferably 0.3 to 1.2 mm, and it is more preferably 0.5 to 1 mm. Furthermore, as to the arrangement of the fluid jet holes, it is preferable that they are arranged with an equal pitch in a range of 0.8 to 1.6 mm for obtaining an even entangled part. The length of each thread handling area to be sectioned for each row of the fluid jet holes is preferably 10 to 40 mm. In particular, when the length is 40 mm or more, although the reason thereof is not known, turbulence of the yarns, which is considered to be derived from the turbulence of the flow of the jetted fluid, occurs at both ends of the thread handling areas so as to easily generate knot portions with each yarn forming a small bundle.

Furthermore, the interval between the respective thread handling areas is preferably in a range of 1 mm to 100 mm, more preferably it is 2.5 mm to 50 mm. By setting the interval in this range, although the reason is not known, the fluid jetted from the fluid jet holes in each thread handling area is discharged from both ends of each thread handling area via the thread handling areas such that it is clashed against the fluid discharged from the adjacent thread handling areas and be discharged from the main body of the fluid processing means toward sideward thereof. In particular, when discharge is limited in the yarn overlaying direction, that is, in the height direction by the common base plate or the upper-lid-side common plate as shown in FIG. 2, the fluid discharge to sideward becomes the main stream, and as a result, the fiber yarns are spread in the width direction of the thread handling area having the flat rectangular shape so as to enable the even entanglement.

Furthermore, it is preferable that the fluid processing unit of the present invention has a structure dividable into half in the longitudinal direction of the yarns to be overlaid in terms of the operability at the time of disposing the fiber yarns. The fiber yarns are overlaid in a state divided into half and disposed on the thread handling areas, and then the fluid processing means main body is closed. The fixing method at the time of closing is not particularly limited, and thus appropriate means such as fastening by a screw, a clamp, or the like can be selected. Furthermore, it is preferable that the fluid processing means divided into half along the thread handling areas has the thread handling areas integrated by a predetermined interval per row unit of the fluid jet holes, or they are mounted on the common base in terms of the convenience of the opening or closing operation.

In addition, according to the present invention, yarn cutting means can be provided on the both end sides in the thread handling area direction of the fluid processing unit and on the inner side of the yarn gripping devices. In this case, it is preferable that the cutting position is provided with the distance from the connecting portion as small as possible so that the generated end yarn is trimmed shortly in terms of prevention of winding of the end yarns around the roll in the following steps. Moreover, as to the end yarns generated at the connecting portion of the yarns on the standby side bobbin, since a long end yarn can easily be the cause of winding to the roll in the following steps, it is preferable to provide the cutting means for trimming the end yarns as short as possible. From the reasons, the cutting position by the cutting means can be set within 30 mm from the end of the overlaid and entangled connecting portion.

The cutting means is not particularly limited as long as it is a device to be supplied for ordinary cutting, comprising a cutting gear, or the like, capable of cutting the precursor fiber yarns, for example, scissors, a shirring device, a circular saw-like cutting device having a rotary blade, a reciprocal clipper device having a fixed blade, an ultrasonic cutter, or the like.

According to the invention, the aforementioned fluid processing unit divided into half can further be provided movably in the thread handling area direction independently. By adopting the configuration, as shown in FIG. 3, at the time of entangling and connecting the fiber yarns, they can be cut by the cutting means preliminarily such that the end yarns can be short at the both ends of the fluid processing unit. Then, the fluid is jetted with the fluid processing means divided into half with respect to the yarn direction moved each on the yarn gripping device side such that the top ends of the cut end yarns are disposed on the yarn gripping device side in the vicinity of the fluid jet hole, thereby mixing the end yarns into the entangled portion.

At the time, although it depends on the pressure of the supplied fluid, the fineness of the yarns to be connected, or the like, by jetting the fluid after providing the distance from the fluid jet holes to the end face of the cut yarns within 10 mm, more preferably 5 mm, the end yarns can be mixed into the entangled portion. As a result, winding of the yarns to the roll derived form the end yarns in the carbon fiber production process, fiber mixture with the adjacent precursor yarns, and furthermore, running disturbance by groove skipping by the groove roll, or the like derived from the fiber mixture can be avoided.

The leading end of the precursor fiber yarn newly supplied in the carbon fiber production process and the trailing end of the precursor fiber yarn supplied preliminarily to the flame resistant process or the carbonizing process are connected using the connecting device. At the time of connecting the ends of the precursor fiber yarns by the connecting device, since the continuous process is executed in the flame resistant process or the carbonizing process while stopping running of the running precursor fiber yarns by the gripping device of the connecting device, the preceding precursor fiber yarn continues to run.

Therefore, according to the carbon fiber producing device of the present invention, it is preferable that a temporary storage unit for temporarily storing a precursor fiber yarn being transported is provided between the connecting device for the precursor fiber yarn and the flame resistant process or the carbonizing process on the downstream side. The temporary storage unit comprises, for example, a movable roll mechanism. As the movable roll mechanism, there are a dancer roll system of running a precursor fiber yarn placed on a roll surface on the opposite side of a roll member forcing direction forced in one direction by a spring, or the like along the running path of the precursor fiber yarn for a pendulum-like operation, a system of running a precursor fiber yarn placed on a roll surface on the loaded side of a running block movable freely in the up and down direction with a certain load for elevating the running block-like roll member in the up and down direction, and the like, and any one can be selected optionally from the systems.

The precursor fiber yarn to be temporarily stopped at the connecting portion of the precursor fiber yarns during the operation of the gripping devices. On the other hand, they are supplied continuously to the flame resistant process or the carbonizing process so as to be supplied continuously and smoothly to each process while maintaining the tension substantially constantly by the movable roll mechanism of the temporary storage unit. When the gripping devices are not operated, with the precursor fiber yarns of the necessary and a sufficient supply length at the time of operating the gripping devices ensured, such are supplied continuously to the flame resistant process or the carbonizing process while temporarily storing the precursor fiber yarns of a certain amount by the forcing power or the load of the movable roll mechanism of the temporary storage unit.

Furthermore, according to the invention, it is also possible to provide a detector for detecting the trailing end of the precursor fiber yarn in the running path of the precursor fiber yarn on the yarn upstream side of the connecting device.

Although the kind of the detector for detecting the trailing end of the yarn is not limited at all, it is preferable to use a photoelectric detector that is not contacted with the yarn. By detecting passage of the trailing end of the running precursor fiber yarn by the detector, the pressured fluid is supplied to the fluid processing unit by operating, for example, a valve for supplying a pressured fluid provided in the yarn connecting device so as to automatically execute the operation for connecting the yarn ends with each other.

According to the invention, the fiber yarns can be produced continuously by using the connecting device for connecting the trailing end of the preceding precursor fiber yarn for producing the carbon fiber and the leading end of the following precursor fiber yarn. That is, the entangling process is applied by first overlaying the ends of the precursor fiber yarns to be connected with each other, gripping the both ends of the overlaid part of the precursor fiber yarns by the yarn gripping means, and jetting a plurality of rows of fluid to the overlaid part between the yarn gripping devices in the longitudinal direction by the fluid processing means.

It is preferable that at least one of the precursor fiber yarns to be connected is provided preliminarily as a flame resistant yarn or the connecting end is processed to be flame resistant before connecting the trailing end and the leading end of the precursor fiber yarns. Furthermore, it is also possible to connect the trailing end and the leading end of the precursor fiber yarns via a flame resistant fiber. Also in this case, a pair of the gripping means on the both ends of the connecting portion of the precursor fiber yarns is sufficient. The flame resistant process for the fiber yarn ends is not particularly limited, and thus it can be carried out, for example, by executing a heating process at 200 to 300° C. in the air, ozone, or another oxidized atmosphere. As the device for executing the heating process, a hot air circulating furnace, a drier using an electric heater, or the like can be used.

In the case of an acrylic based fiber yarn provided in a form wound around on a bobbin by a winder, the flame resistant process of the final end can be executed easily. That is, the final end can be processed with the above-described hot air circulating furnace, or the like after finishing the winding-up operation. On the other hand, for the flame resistant process to the winding starting end, the winding starting end is wound around under the fiber yarn to be wound up by the winder. That is, the fiber yarn is wound up while being overlaid on the winding starting yarn end.

Therefore, even after finishing the winding-up operation for a predetermined amount, the inability of taking up the winding starting end from the bobbin should be avoided. Therefor, for example, at the time of starting winding the fiber yarn, the yarn leading end of a length sufficient for the heating process by the hot air circulating furnace, or the like later is wound up at a position displaced form the yarn path to be wound up for forming the bobbin for winding up the following yarn and forming a predetermined bobbin. Moreover, in the case where the trailing end of the preceding precursor fiber yarn and the leading end of the following precursor fiber yarn are to be connected via a flame resistant fiber at the time of the connecting operation, the fiber yarn after passing through the flame resistant process can be used as the flame resistant fiber.

BEST MODES FOR CARRYING OUT THE INVENTION

Hereinafter, an example for producing a carbon fiber continuously will be explained specifically mainly about the process passing property by employing the connecting device for yarns and the connecting method constituting the characteristic part the invention using an acrylic based fiber yarn as the precursor fiber yarn for producing a carbon fiber. The process passing ratio presented in the following examples and comparative example is the number of connecting portions without cutting in each process for carbon fibers produced by providing a flame resistant process and a carbonizing process to acrylic based fiber yarns having connecting portions represented by the percentage (%) with respect to the number of all the connecting portions of the yarns to be tested. Moreover, the process tension (mN/Tex) is a numerical value of the tension of the acrylic fiber yarns in the flame resistant process and the carbonizing process at the time of producing the carbon fibers using the acrylic based fiber yarns having the connecting portions converted per unit fineness.

Figure 4:
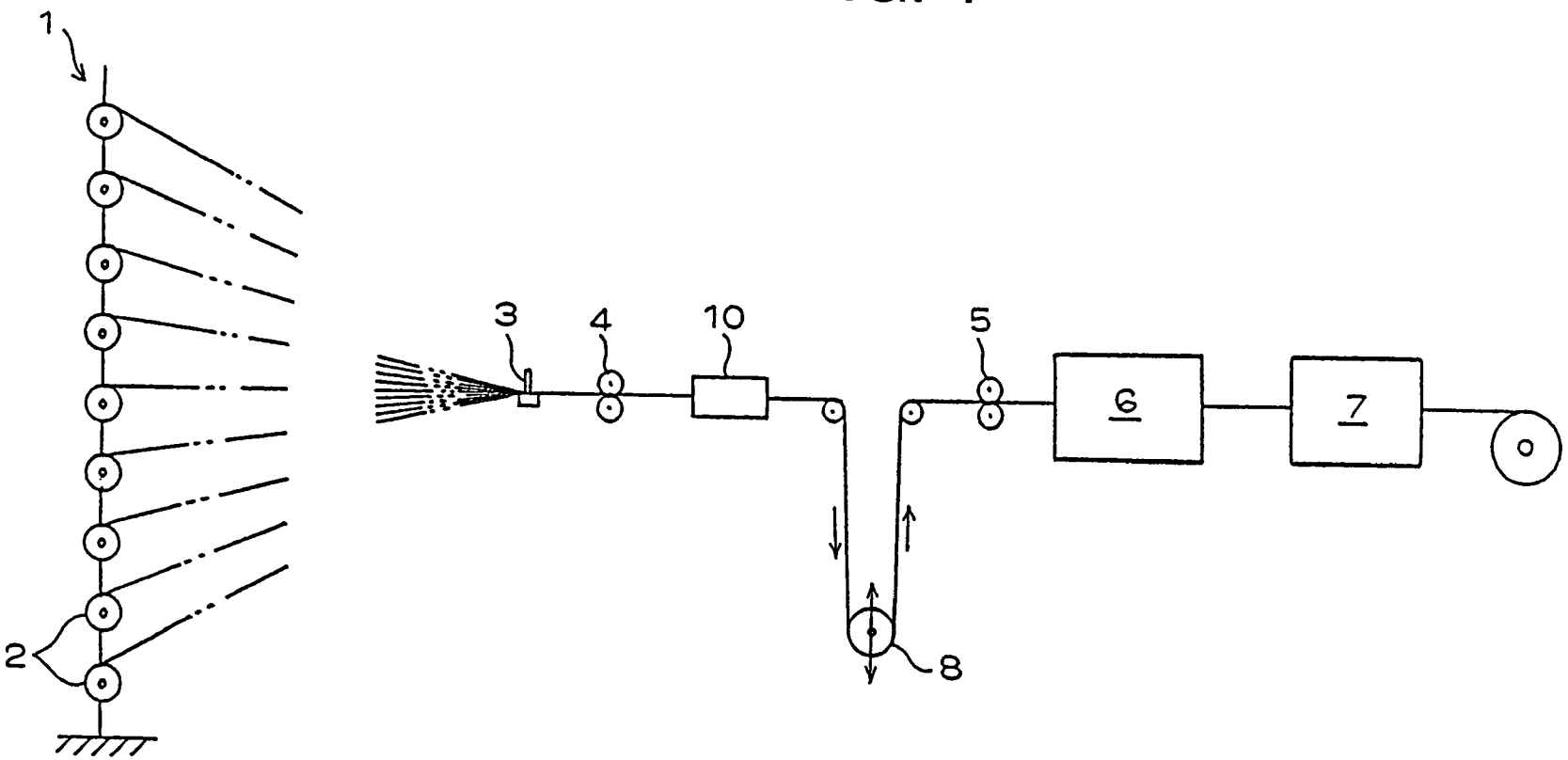
FIG. 4 is a production process explanatory view for a carbon fiber by the present invention.

As shown in FIG. 4, according to the carbon fiber production, precursor fiber yarns are taken out from bobbins 2 on a creel 1 so as to be arranged in the horizontal direction by a comb tooth-like guide 3, supplied to a flame resistant process 6 and a carbonizing process 7 via first and second feed rollers 4, 5 for having each process, and are taken up continuously by a winder as the carbon fiber as a final fiber. In the examples hereafter, a yarn gripping device 10 and a running block-like movable roll 8 constituting a temporary storage unit for a yarn, which are characteristic parts of the present invention, are provided between the first feed roller 4 and the second feed roller 5.

The movable roll 8 for balancing while applying a certain tension to the precursor fiber yarn under a certain load at the time when the yarn connecting device 10 is in a non-operation state, is disposed below an ordinary yarn transporting path. Now, when the yarn connecting device 10 is in an operation state, the fist feed roller 4 is stopped so as to stop the supply of the precursor fiber yarn from the creel 1. On the other hand, since the supply of the precursor fiber yarn to the flame resistant process 6 and the carbonizing process 7 is continued during that time, the movable roll 8 is lifted upward by the precursor fiber yarn so that the precursor fiber yarn is supplied smoothly to the flame resistant process 6 and the carbonizing process 7 under a predetermined tension.

EXAMPLE 1

By applying a flame resistant process to an end of an acrylic based fiber yarn of a 1.2 dTex/filament single yarn fineness and a 12,000 filament number in a furnace with hot air of 240° C. circulating under a 5 mN/tex tension for 70 minutes, an acrylic based fiber yarn A having a 1.36 g/cm$^3$ density with the flame resistant end, and another acrylic based fiber yarn B were prepared.

Figure 1:
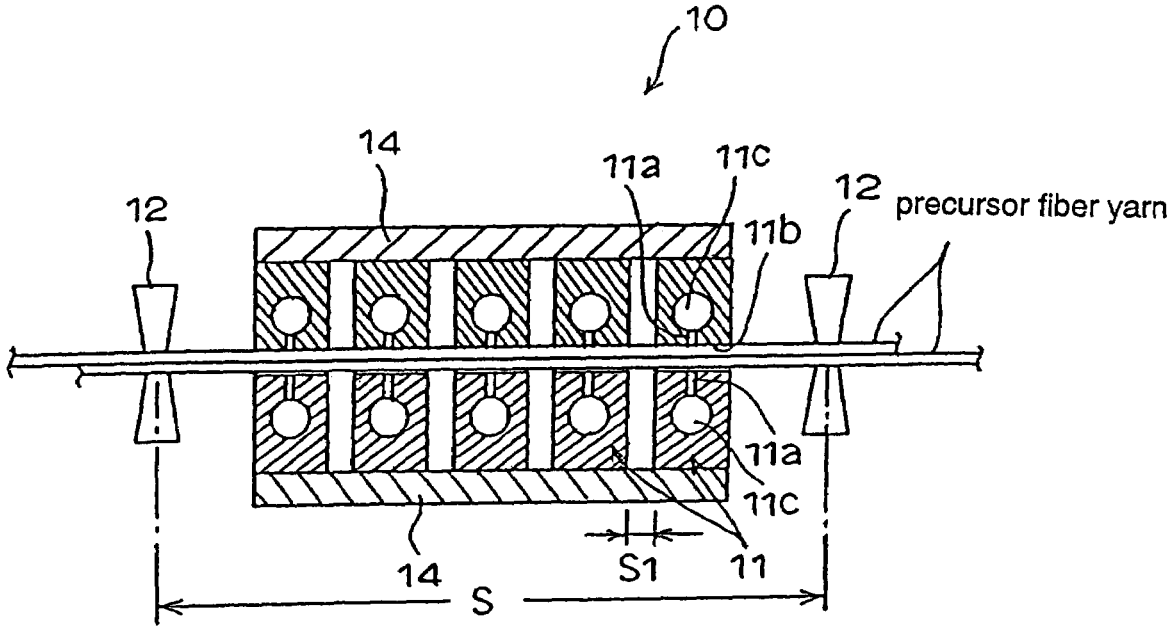
FIG. 1 is a cross-sectional view showing a schematic configuration example of a representative yarn connecting device to be applied to the present invention.
Figure 2:
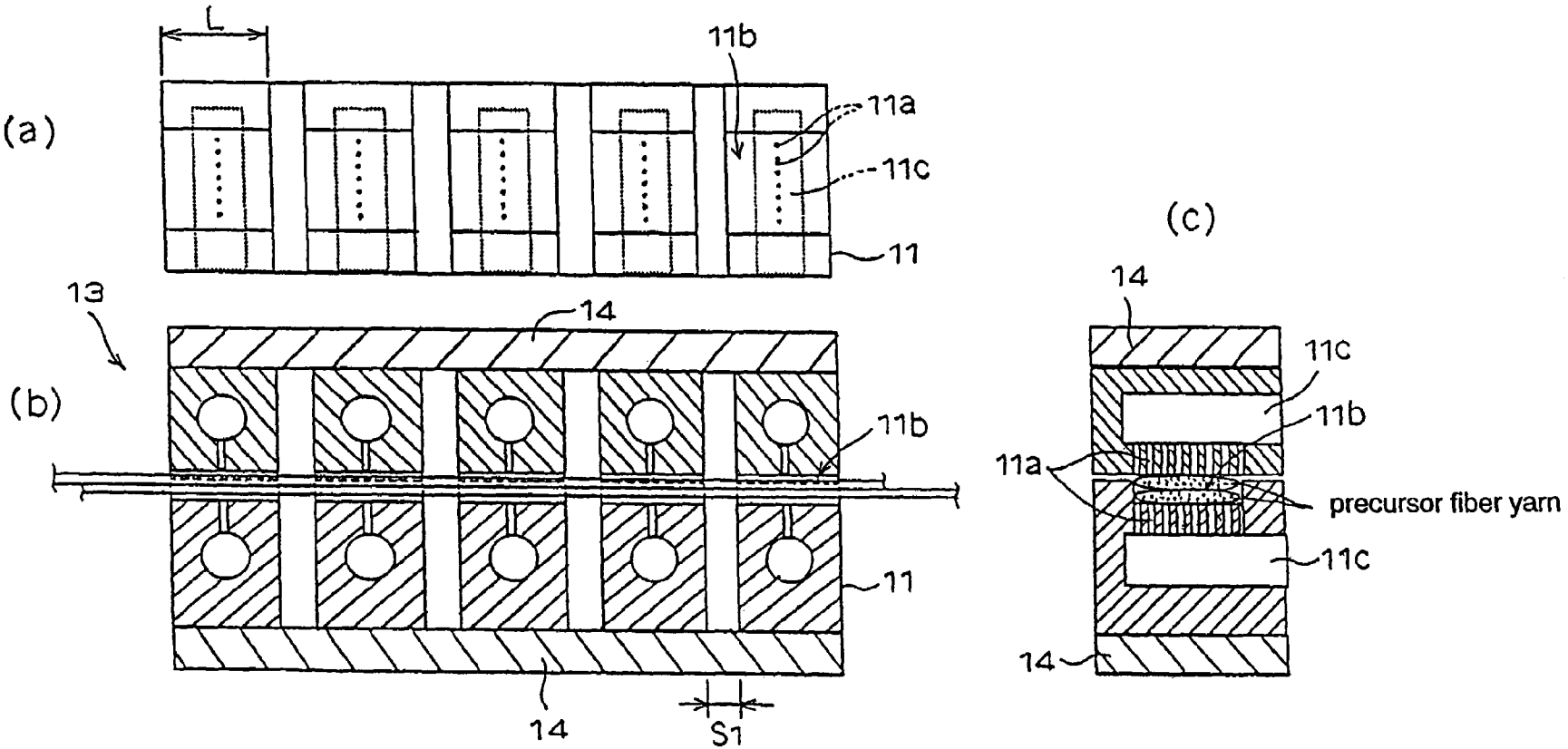
FIG. 2 is a configuration explanatory view showing an embodiment of a fluid jetting nozzle of the yarn connecting device.

For the flame resistant end of the acrylic based fiber yarn A and the end of the acrylic based fiber yarn B, with applying the jetting nozzle 11 as fluid jetting means shown in FIG. 2 to the yarn connecting device 10 shown in FIG. 1, both ends of the fiber yarns A and B were entangled and connected using the air as the jetting fluid with the fiber yarn ends overlaid. In this example, the installation distance S between a pair of yarn gripping devices 12, 12 in the yarn connecting device 10 shown in FIG. 1 was 300 mm. A plurality of jetting nozzles 11, 11, . . . have the structure shown in FIG. 2. The nozzle thread handling area length L per each air jetting hole 11*a* as a fluid jet hole was 20 mm. The distance S1 between the adjacent nozzles 11, 11, . . . was 5 mm, and they were arranged by 10 pieces.

Figure 3:
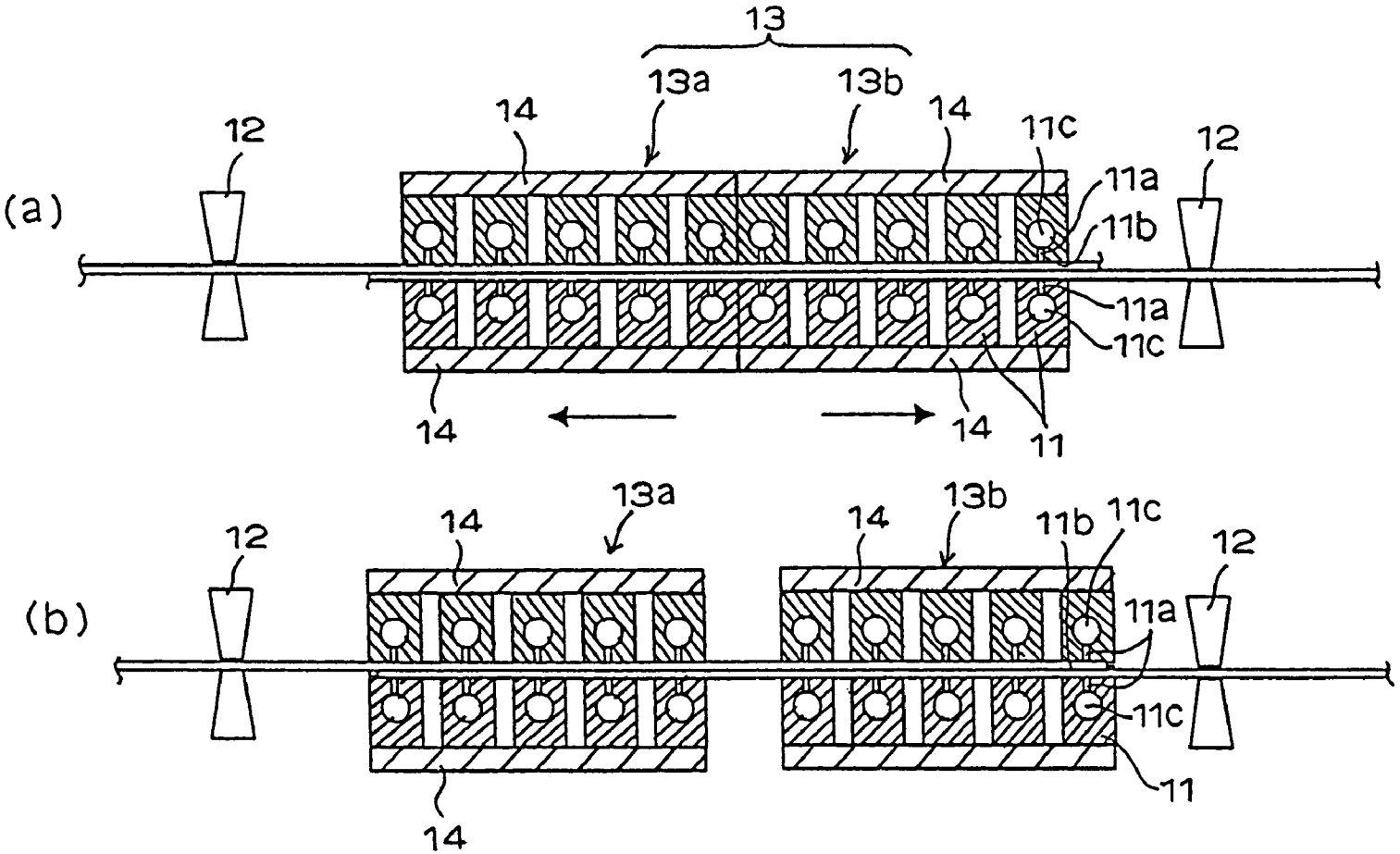
FIG. 3 is an explanatory view for a yarn connecting procedure according to another embodiment of the yarn connecting device.

Each thread handling area 11*b* with a rectangular cross-sectional shape of 8 mm×2.5 mm has air supply openings 11*c* formed on the upper and lower parts of each thread handling area 11*b* along the longer side direction of the rectangular cross-section such that each air supply opening 11*c* communicates with the air jetting hole 11*a*. The air jetting holes 11*a* were formed each in 10 portions vertically in each thread handling area 11*b*. The diameter of the air jetting hole 11*a* is 0.5 mm. Furthermore, according to this example, as shown in FIG. 3(*a*), a main body 13 of a fluid processing unit has a structure dividable into half. In each divided member 13*a*, 13*b*, the jetting nozzles 11, 11, . . . are arranged each in 5 rows such that the upper and lower surfaces of the jetting nozzles 11, 11, . . . are fixed and integrated with the common plate 14.

In the thread handling area 11*b* of the fluid processing unit having the configuration, the flame resistant end of the acrylic based fiber yarn A and the end of the acrylic based fiber yarn B without the flame resistant process were overlaid and stored so that the both ends of the overlaid part were gripped by the gripping devices 12 without slacking thereof in the sate with the yarns overlaid, and then the divided members 13*a*, 13*b* of the fluid processing means were closed. Thereafter, by shortening the gripping distance of the yarn gripping devices 12, 12 by 7.5 mm, slack was applied to the yarns. In this state, by supplying the entangling air by a 2.5 kg/cm$^2$ pressure for 3 seconds, the flame resistant end of the yarn A and the end of the yarn B without the flame resistant process were entangled and connected, and the excessive end yarns were cut off with the scissors so as to have 20 mm remain.

The acrylic fiber yarn having the connecting portion was provided for the flame resistant process for 30 minutes in a flame resistant furnace with the hot air of 230 to 270° C. circulating while limiting contraction of the acrylic fiber yarn by a 14 mN/Tex process tension, and then for the carbonizing process for 2 minutes in a carbonizing furnace containing a nitrogen atmosphere having a 300 to 1,300° C. temperature distribution while limiting contraction of the acrylic fiber yarn by a 7 mN/Tex process tension so as to produce a carbon fiber.

The process passing ratios of the yarn connecting portion in the flame resistant process and the carbonizing process in the carbon fiber production process at the time are as shown in Table 1.

EXAMPLE 2

By applying a flame resistant process to an end of an acrylic based fiber yarn of a 1.2 dTex/filament single yarn fineness, and a 24,000 filament number in a furnace with hot air of 240° C. circulating under a 5 mN/tex tension for 70 minutes, an acrylic based fiber yarn C having a 1.36 g/cm$^3$ density with the flame resistant end, and another acrylic based fiber yarn D without applying a special flame resistant process to the end were prepared.

The flame resistant end of the acrylic based fiber yarn C and the end of the acrylic based fiber yarn D without the flame resistant process were entangled and connected by jetting the air with the jetting nozzle 11 shown in FIG. 2 in the yarn connecting device 10 shown in FIG. 1. In this example, the distance S between the yarn gripping devices 10 was 300 mm. The jetting nozzles 11 had the structure shown in FIG. 2. The nozzle thread handling area length L per each air jetting hole 11*a* was 20 mm. The main bodies 13 were arranged by a 5 mm distance of the adjacent jetting nozzles 11 in 10 rows.

The thread handling areas 11*b* had a rectangular cross-sectional shape of 16 mm×2.5 mm. The air supply openings 11*c* were formed on the upper and lower parts of the thread handling areas 11*b*. The air jetting holes 11*a* were formed each in 20 portions vertically in each thread handling area 11*b* with a 0.5 mm diameter. The main body 13 of the fluid processing unit has a structure dividable into half. The upper and lower surfaces of the jetting nozzles 11, 11, . . . arranged each in 10 rows per each divided member (not shown) are fixed and integrated with the common plate 14.

In the thread handling area 11*b* of the fluid processing unit having the configuration, the flame resistant end of the acrylic based fiber yarn C and the end of the acrylic based fiber yarn D without the flame resistant process were overlaid and stored so that the overlaid parts of the precursor fiber yarn and the flame resistant yarn part were gripped by the gripping devices 12 without slacking thereof in the state with the yarns overlaid, and then the divided fluid processing unit was closed. Thereafter, by shortening the gripping distance of the yarn gripping devices 12 by 7.5 mm, slack was applied to the yarns.

In this state, by supplying the entangling air by a 2.5 kg/cm$^2$ pressure for 3 seconds, the flame resistant end of the yarn C and the end of the acrylic based fiber yarn D without the flame resistant process were entangled and connected, and the excessive end yarns were cut off and eliminated with the scissors so as to have 20 mm remain. The acrylic fiber yarn having the bonding part was provided for the flame resistant process for 60 minutes in a flame resistant furnace with the hot air of 230 to 270° C. circulating while limiting contraction of the acrylic fiber yarn by a 14 mN/Tex process tension, and then for the carbonizing process for 2 minutes in a carbonizing furnace containing a nitrogen atmosphere having a 300 to 1,300° C. temperature distribution while limiting contraction of the acrylic fiber yarn by a 7 mN/Tex process tension so as to produce a carbon fiber.

The process passing ratios of the yarn bonding part in the flame resistant process and the carbonizing process in the carbon fiber production process at the time are as shown in Table 1.

EXAMPLE 3

By applying a flame resistant process to an end of an acrylic based fiber yarn of a 1.2 dTex/filament single yarn fineness, and a 48,000 filament number in a furnace with hot air of 240° C. circulating under a 5 mN/tex tension for 70 minutes, an acrylic based fiber yarn E having a 1.36 g/cm$^3$ density with the flame resistant end, and another acrylic based fiber yarn F without applying a special flame resistant process were prepared.

The flame resistant end of the acrylic based fiber yarn E and the end without the flame resistant process of the acrylic based fiber yarn F were entangled and connected by entanglement by jetting the air using the jetting nozzle 11 shown in FIG. 2 in the yarn connecting device 10 shown in FIG. 1. In this example, the distance S between the yarn gripping devices 12 was 300 mm. The jetting nozzles 11 had the structure shown in FIG. 2. The nozzle thread handling area length L per each air jetting hole 11*a* was 20 mm. The adjacent nozzles were arranged by a 5 mm distance in 10 rows.

The thread handling areas 11*b* had a rectangular cross-sectional shape of 32 mm×2.5 mm. The air supply openings 11*c* were formed on the upper and lower parts of the thread handling areas 11*b*. The air jetting holes 11*a* communicating with the air supply openings 11*c* were each formed in 40 portions vertically in each thread handling area 11*b* with a 0.5 mm diameter. The main body 13 of the fluid processing unit has a structure dividable into half. To the divided members (not shown), the jetting nozzles having the interval and arranged in 10 rows were fixed with the common plate as in the example.

In the thread handling area 11*b* of the fluid processing unit having the configuration, the flame resistant end of the acrylic based fiber yarn E and the end of the acrylic based fiber yarn F without the flame resistant process were overlaid and stored so that the both ends of the overlaid parts of the acrylic based fiber yarn E and the acrylic based fiber yarn F were gripped by the gripping devices 12 without slacking thereof in the state with the yarns overlaid, and then the divided members were closed. Thereafter, by shortening the gripping distance of the yarn gripping devices by 7.5 mm, slack was applied to the yarns. In this state, by supplying the entangling air by a 2.5 kg/cm$^2$ pressure for 3 seconds, the flame resistant end of the yarn E and the acrylic based fiber yarn end of the yarn F were entangled and connected, and the excessive end yarns were cut off and eliminated with the scissors so as to have 20 mm remain.

The acrylic fiber yarn having the bonding part was provided for the flame resistant process for 60 minutes in a flame resistant furnace with the hot air of 230 to 270° C. circulating while limiting contraction of the acrylic fiber yarn by a 14 mN/Tex process tension, and then for the carbonizing process for 2 minutes in a carbonizing furnace containing a nitrogen atmosphere having a 300 to 1,300° C. temperature distribution while limiting contraction of the acrylic fiber yarn by a 7 mN/Tex process tension so as to produce a carbon fiber.

The process passing ratios of the yarn bonding part in the flame resistant process and the carbonizing process in the carbon fiber production process at the time are as shown in Table 1.

EXAMPLE 4

As in Example 1, by applying a flame resistant process to an end of an acrylic based fiber yarn of a 1.2 dTex/filament single yarn fineness, and a 12,000 filament number in a furnace with hot air of 240° C. circulating under a 5 mN/tex tension for 70 minutes, an acrylic based fiber yarn G having a 1.36 g/cm$^3$ density with the flame resistant end, and another acrylic based fiber yarn H without applying a flame resistant process were prepared.

The flame resistant end of the acrylic based fiber yarn G and the end of the acrylic based fiber yarn H without the flame resistant process were entangled and connected by entanglement by the air using the yarn connecting device 10 shown in FIG. 3. In this example, according to the yarn connective device 10 shown in FIG. 3, the gripping distance S of the yarn gripping devices 12 was 300 mm. The jetting nozzles 11 had the structure shown in FIG. 2. The nozzle thread handling area length per each jetting hole 11*a* of the jetting nozzle 11 was 20 mm. The adjacent jetting nozzles were arranged by a 5 mm arrangement interval, and two sets of the fluid processing units each having the same by 5 rows were used.

Each fluid processing unit has thread handling areas 11*b* with a rectangular cross-sectional shape of 8 mm×2.5 mm. The air supply openings 11*c* were formed on the upper and lower parts of the thread handling areas 11*b*. The air jetting holes 11*a* communicating with the air supply openings 11*c* were formed each in 10 portions vertically in each thread handling area 11*b* with a 0.5 mm diameter. The main body 13 of the fluid processing unit has a structure dividable into half. A set of the jetting nozzle group arranged each in 5 rows is fixed with the common plate.

In the thread handling area 11*b* of the main body 13 having the configuration, the flame resistant end of the acrylic based fiber yarn G and the end of the acrylic based fiber yarn H without the flame resistant process were overlaid and stored so that the both ends of the overlaid parts of the acrylic based fiber yarns G and H were gripped by the gripping devices 12 without slacking thereof in the state with the ends of the yarns G, H overlaid, and then the main bodies 13, 13 of the two sets of the fluid processing units were closed along the thread handling areas 11*b*.

Thereafter, the end yarn of the flame resistant leading end of the acrylic based fiber yarn G and the trailing end of the acrylic based yarn fiber G projecting from the both ends on the outer side of the pair of yarn gripping devices 12 were cut by the ultrasonic cutter SUW-30CMH produced by Suzuki Corp. As to the blade type used at the time, the type number H4 made of a steel material of a high speed tool steel having a 0.5 mm blade thickness, with a stainless steel jig having a 30 degree angle with respect to the blade tip with a 0.3 mm distance from the both surfaces of the blade for closely contacting the yarn with the blade, was used. By inserting the cutter so as to dispose the yarn between the blade and the jig inclined surface, the end yarn was cut.

After cutting the end yarn accordingly, as shown in FIG. 3(*b*), the main body 13 of the fluid processing unit with each 5 rows provided as a set was moved each toward the yarn gripping devices 12 by 25 mm so as to set the distance between the end yarn top end and the air jetting hole 11*a* adjacent to the top end to 5 mm. After the operation, by shortening the gripping distance of the yarn gripping devices by 7.5 mm, slack was applied to the yarns. In this state, by supplying the entangling air by a 2.5 kg/cm$^2$ pressure for 3 seconds, the flame resistant end of the yarn G and the acrylic based fiber yarn end of the yarn H without the flame resistant process were entangled and connected. The obtained bonding part had a state with the end yarn mixed.

The acrylic fiber yarn having the bonding part was provided for the flame resistant process for 30 minutes in a flame resistant furnace with the hot air of 230 to 270° C. circulating while limiting contraction of the acrylic fiber yarn by a 14 mN/Tex process tension, and then for the carbonizing process for 2 minutes in a carbonizing furnace containing a nitrogen atmosphere having a 300 to 1,300° C. temperature distribution while limiting contraction of the acrylic fiber yarn by a 7 mN/Tex process tension so as to produce a carbon fiber.

The process passing ratios of the yarn bonding part in the flame resistant process and the carbonizing process in the carbon fiber production process at the time are as shown in Table 1.

EXAMPLE 5

By applying a flame resistant process to an end of an acrylic based fiber yarn of a 1.2 dTex/filament single yarn fineness, and a 48,000 filament number in a furnace with hot air of 240° C. circulating under a 5 mN/tex tension for 70 minutes, an acrylic based fiber yarn I having a 1.36 g/cm$^3$ density with the flame resistant end, and another acrylic based fiber yarn J with the end processed in the same manner were prepared.

The flame resistant end of the acrylic based fiber yarn I and the flame resistant end of the acrylic based fiber yarn J were entangled and connected by entanglement by jetting the air using the jetting nozzle 11 shown in FIG. 2 in the yarn connecting device 10 shown in FIG. 1. In this example, the distance S between the yarn gripping devices 12 was 300 mm. The jetting nozzles 11 having the structure shown in FIG. 2 were used. The nozzle thread handling area length L per each air jetting hole 11*a* was 20 mm. The adjacent nozzles were arranged by a 5 mm distance in 10 rows.

The thread handling areas 11*b* had a rectangular cross-sectional shape of 32 mm×2.5 mm. The air supply openings 11*c* were formed on the upper and lower parts of the thread handling areas 11*b*. The air jetting holes 11*a* having a 0.5 mm hole diameter, communicating with the air supply openings 11*c* were formed each in 40 portions vertically in each thread handling area 11*b*. The main body 13 of the fluid processing unit had a structure dividable into half. The air jetting nozzles 11 arranged in 10 rows were fixed with the common plate 14.

In the thread handling area 11*b* of the fluid processing unit main body 13, the flame resistant end of the acrylic based fiber yarn I and the flame resistant end of the acrylic based fiber yarn J were overlaid and stored so that the both ends of the overlaid parts of the acrylic based fiber yarn I and the acrylic based fiber yarn J were gripped by the gripping devices 12 without slacking thereof in the state with the yarns overlaid, and then the main body 13 of the fluid processing unit divided and separated was closed. Thereafter, by shortening the gripping distance of the yarn gripping devices by 7.5 mm, slack was applied to the yarns. In this state, by supplying the entangling air by a 2.5 kg/cm$^2$ pressure for 3 seconds, the flame resistant end of the yarn E and the end of the acrylic based fiber yarn J of the yarn F were entangled and connected, and the excessive end yarns were cut off and eliminated with the scissors so as to have 20 mm remain.

The acrylic fiber yarn having the bonding part was provided for the flame resistant process for 60 minutes in a flame resistant furnace with the hot air of 230 to 270° C. circulating while limiting contraction of the acrylic fiber yarn by a 14 mN/Tex process tension, and then for the carbonizing process for 2 minutes in a carbonizing furnace containing a nitrogen atmosphere having a 300 to 1,300° C. temperature distribution while limiting contraction of the acrylic fiber yarn by a 7 mN/Tex process tension so as to produce a carbon fiber.

The process passing ratios of the yarn bonding part in the flame resistant process and the carbonizing process in the carbon fiber production process at the time are as shown in Table 1.

COMPARATIVE EXAMPLE 1

In the same manner as in Example 1 using the jetting nozzle having the same structure as in Example 1 except that the air jetting nozzles used for the entanglement and the connection had the structure with the thread handling areas provided continuously, an acrylic based fiber yarn K having the flame resistant end, and another acrylic based fiber yarn L without the flame resistant process were connected by entangling by supplying the air of the same pressure as in Example 1 for 3 seconds. The acrylic fiber yarn having the bonding part was supplied to the carbon fiber production process with the same conditions as in Example 1. The process passing ratios of the connecting portion in the flame resistant process and the carbonizing process in the carbon fiber production process at the time are as shown in Table 1. The supplied bonding parts were cut in the flame resistant process so that they cannot be supplied to the subsequent processes. According to the bonding parts obtained at the time, the entanglement was not even for each jetting hole. In particular, the entanglement was insufficient in the vicinity of the nozzle center with respect to the yarn longitudinal direction. Moreover, the supplied air pressure was 5 kg/cm$^2$ similarly.

TABLE 1

| | | | | | Flame resistant process | | Carbonizing process | | Process passing ratio | |
|---|---|---|---|---|---|---|---|---|---|---|
| | Bonding part | Single yarn fineness (dTex) | Filament number (pieces) | Connecting method | Time (minutes) | Process tension (mN/Tex) | Time (minutes) | Process tension (mN/Tex) | Flame resistant process | Carbonizing process |
| Example 1 | One-side flame resistant process | 1.2 | 12000 | After the entanglement and connection, the end yarns were cut with the scissors. | 30 | 14 | 2 | 7 | 100 | 100 |
| Example 2 | One-side flame resistant process | 1.2 | 24000 | Same as above | 60 | 14 | 2 | 7 | 100 | 100 |
| Example 3 | One side flame resistant process | 1.2 | 48000 | Same as above | 60 | 14 | 2 | 7 | 100 | 100 |
| Example 4 | One-side flame resistant process | 1.2 | 12000 | After cutting the end yarns, the entanglement and connection were executed with the nozzle moved. | 30 | 14 | 2 | 7 | 100 | 100 |

TABLE 1-continued

| | Bonding part | Single yarn fineness (dTex) | Filament number (pieces) | Connecting method | Flame resistant process | | Carbonizing process | | Process passing ratio | |
|---|---|---|---|---|---|---|---|---|---|---|
| | | | | | Time (minutes) | Process tension (mN/Tex) | Time (minutes) | Process tension (mN/Tex) | Flame resistant process | Carbonizing process |
| Example 5 | Both-side flame resistant process | 1.2 | 48000 | After the entanglement and connection, the end yarns were cut with the scissors. | 60 | 14 | 2 | 7 | 100 | 100 |
| Comparative example 1 | One-side flame resistant process | 1.2 | 12000 | After the entanglement and connection, the end yarns were cut with the scissors. | 30 | 14 | 2 | 7 | 0 | — |

As it is apparent from the explanation above, at the time of producing a carbon fiber by supplying precursor fiber yarns to the firing process including the flame resistant process and the carbonizing process, according to the present invention, in spite of the simple mechanism, the connecting device for obtaining a yarn having a high process passing property was developed. Accordingly, the complete continuous production, which has not been realized by the conventional technique, was enabled so that the operability of the firing process was improved remarkably and a low cost can be realized.

The invention claimed is:

1. A production device for carbon fibers, for connecting precursor fiber yarns, which comprises a pair of yarn gripping devices for overlaying the precursor fiber yarns to be connected one upon another and gripping the overlaid yarns, a fluid processing unit disposed between the pair of yarn gripping devices for applying an entangling process by jetting a plurality of rows of fluid with respect to a longitudinal direction of an overlaid part of the precursor fiber yarns, and a plurality of discontinuous thread handling areas of the precursor fiber yarns in a fluid jet area of the fluid processing unit are disposed at predetermined intervals in a longitudinal direction of the yarns.

2. A production device according to claim 1, wherein a cross-section of each thread handling area has a flat rectangular shape, and a plurality of fluid jet holes of the fluid processing unit are arranged at predetermined intervals in a longer side direction of the flat rectangular shape of the thread handling area.

3. A production device according to claim 1 or 2, wherein the fluid processing unit having fluid jet holes has a structure dividable into half in a longitudinal direction of overlaid yarns, and each of divided fluid processing units is integrated or mounted on a common base such that the thread handling areas arranged per row unit of the fluid jet holes have predetermined intervals.

4. A production device according to claim 3, wherein the fluid processing units divided into half are provided movably in a thread handling area direction independently.

5. A production device according to claim 1, which comprises cutting means for the yarns which are provided on both end sides of a thread handling area direction of the fluid processing unit and an inner side of the yarn gripping devices.

6. A production device according to claims 1 or 2, wherein a cutting position by cutting means is set within 30 mm from an end of a connecting portion overlaid and entangled.

7. A production device according to claims 1 or 2, which comprises a temporary storage unit for temporarily storing precursor fiber yarns according to a tension fluctuation of the precursor fiber yarns being moved between a connecting device of the precursor fiber yarns for producing carbon fibers and a flame resistant process or a carbonizing process on a downstream side.

8. A production method for carbon fibers, for continuously producing carbon fibers by connecting a trailing end of a preceding precursor fiber yarn and a leading end of a following precursor fiber yarn for the carbon fiber production with using a connecting device according to claims 1 or 2, which comprises the steps of:

overlaying ends of precursor fiber yarns to be connected, gripping both ends of an overlaid part of the precursor fiber yarns by yarn gripping devices, and applying an entangling process to the overlaid part between the yarn gripping devices by jetting a plurality of rows of fluid with respect to a longitudinal direction of the overlaid part by a fluid processing unit.

9. A production method for carbon fibers according to claim 8, wherein at least one of the precursor fiber yarns to be connected comprises a flame resistant yarn or a flame resistant yarn provided by applying a flame resistant process to the connected ends.

10. A production method for carbon fibers according to claim 8, which comprises applying a flame resistant process to each of the connected ends of the precursor fiber yarns to be connected.

* * * * *